United States Patent [19]

Hefti et al.

[11] Patent Number: 4,830,763

[45] Date of Patent: May 16, 1989

[54] PROCESS FOR INCREASING THE DEGREE OF WHITENESS OF POLYESTER-CONTAINING TEXTILE MATERIAL

[75] Inventors: Heinz Hefti, Reinach; Urs Lehmann, Basel, both of Switzerland; Dieter Reinehr, Kandern; Jürgen Kaschig, Freiburg, both of Fed. Rep. of Germany

[73] Assignee: Ciba-Geigy Corporation, Ardsley, N.Y.

[21] Appl. No.: 156,114

[22] Filed: Feb. 16, 1988

[30] Foreign Application Priority Data

Feb. 26, 1987 [CH] Switzerland ..... 740/87

[51] Int. Cl.[4] ..... C09K 11/06; C11D 3/42

[52] U.S. Cl. ..... 252/8.6; 252/301.21; 252/301.22; 252/301.24; 252/301.27; 252/301.28; 427/158

[58] Field of Search ..... 252/8.6, 301.21, 301.22, 252/301.24, 301.27, 301.28; 427/158

[56] References Cited

U.S. PATENT DOCUMENTS

| | | | |
|---|---|---|---|
| 3,555,071 | 1/1971 | Rao et al. | 252/301.21 |
| 3,679,669 | 7/1972 | Maeder et al. | 252/301.28 |
| 3,957,813 | 5/1976 | Irick, Jr. et al. | 252/301.27 |
| 4,217,301 | 8/1980 | Sregvist et al. | 252/301.22 |
| 4,330,427 | 5/1982 | Martini et al. | 252/301.22 |
| 4,400,294 | 8/1983 | Martini et al. | 252/301.24 |
| 4,519,953 | 5/1985 | Heiss | 558/359 |

FOREIGN PATENT DOCUMENTS

| | | |
|---|---|---|
| 580757 | 8/1959 | Canada . |
| 3119992 | 12/1982 | Fed. Rep. of Germany . |

*Primary Examiner*—Paul Lieberman
*Assistant Examiner*—Ronald A. Krasnow
*Attorney, Agent, or Firm*—Edward McC. Roberts

[57] ABSTRACT

A process for increasing the degree of whitness of polyester-containing textile material by the combined application of a fluorescent whitening agent and, as booster, a compound which fluoresces in the absorption range of said fluorescent whitening agent, and a composition for whitening polyester-containing textile material.

5 Claims, No Drawings

PROCESS FOR INCREASING THE DEGREE OF WHITENESS OF POLYESTER-CONTAINING TEXTILE MATERIAL

The present invention relates to a process for increasing the degree of whiteness of polyester-containing textile material by the combined application of fluorescent whitening agents and boosters to said material.

Boosters are compounds which absorb shortwave UV light and transmit the energy absorbed to the fluorescent whitening agent. They are fluorescing compounds which absorb UV light in the range from 300 to 350 nm and fluoresce in the range from 350 to 390 nm. The fluorescence of the booster thus lies in the absorption range of the fluorescent whitening agent, resulting in an increased activity of the fluorescent whitening agent and thereby, in the case of many fluorescent whitening agents, in a substantial increase in the degree of whiteness of the treated polyester-containing textile material.

German Offenlegungsschrift 3 503 146 discloses a process for increasing the degree of whiteness of whitened polyolefins and polystyrene, wherein these materials contain a sterically hindered heterocycLic amine in addition to fluorescent whitening agents.

Compounds that come into the category of boosters which may be suitably employed for increasing the degree of whiteness in conjunction with a known fluorescent whitening agent for treating polyester fibres and textile material which contains polyester fibres are a number of stilbene compounds, for example unsubstituted stilbene or stilbene which is substituted by cyano or $C_1$–$C_9$alkoxycarbonyl groups, as well as a number of heterocyclic compounds that contain nitrogen and oxygen, for example 2-(diphenyl)-5-(4-tertbutylphenyl)-1,3,4-oxadiazole, 2-(diphenyl)benzoxazole and 2-(p-tolyl)-5-tert-butylbenzoxazole. Preferred boosters are 4,4'-bis(cyano)stilbene or 4,4'-bis(ethoxycarbonyl)stilbene, which can be recrystallised beforehand from a solvent, for example dimethyl formamide.

Fluorescent whitening agents which may be used for the process of this invention are a number of compounds that are commonly employed for whitening polyester-containing material, for example 2,4-dimethoxy-6-(1-pyrenyl)-1,3,5-triazine, N-methyl-4,5-diethoxynaphthalimide, 2-(4-chlorostyryl-2-cyanophenyl)-naphthotriazole and 1,4-bis(benzoxazol-2-yl)naphthalene.

Regarding the choice of fluorescent whitening agent and booster for the process of this invention, it has been found that there are specific combinations in which the activating effect of the booster on the fluorescent whitening agent is especially pronounced. Whereas a booster, together with a specific fluorescent whitening agent, is able to effect an additional increase in whiteness of up to 15 whiteness units, the same booster will have hardly any, or no, particular effect on another fluorescent whitening agent in respect of its expected white effect.

The present invention also relates to compositions for whitening polyester-containing textile material, which compositions contain a fluorescent whitening agent and, as booster, a compound which fluoresces in the absorption range of said fluorescent whitening agent.

As is customary with mixtures of fluorescent whitening agents, the compositions of this invention can be prepared by dispersing the individual compounds in a liquid medium, e.g. water, and then by combining the dispersions so obtained. It is, however, also possible to disperse a mixture of the individual compounds jointly in substance, the dispersing operation being carried out in conventional manner in ball mills, bead mills or the like.

The compositions of this invention can be applied to the polyester-containing textile material by known methods, for example by the exhaust process in the temperature range from 90° to 140° C., or by pad-thermofixation in the temperature range from 160° to 220° C. Application is preferably made in aqueous medium, wherein the compounds are present in finely particulate form as suspensions, microdispersions or, as the case may be, solutions. Finally, dispersants, stabilisers, wetting agents and other auxiliaries may also be added during the application.

The invention is illustrated by the following Examples.

EXAMPLE 1

A polyester fabric (Terylene 540) is padded at room temperature with an aqueous liquor containing 0.5 g/l of the fluorescent whitening agent of formula

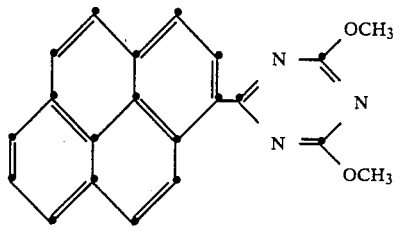

(1)

1 g/l of the compound of formula

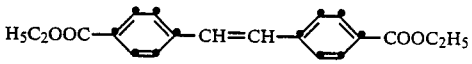

(2)

and 1 g/l of Invadin JFC 200%. The pick-up is 70%. The treated fabric is then dried for 30 minutes at a temperature of 70° C. and subsequently thermofixed for 30 seconds at a temperature of 200° C. The treated polyester fabric has a white effect which is 8 whiteness units higher than the degree of whiteness obtained when a compound of formula (2) is not conjointly used.

EXAMPLE 2

The procedure of Example 1 is repeated, using 1 g/l of a compound of formula

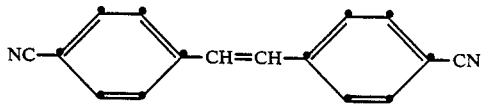

(3)

in place of the compound of formula 2, to give an increase in the degree of whiteness of 11 whiteness units as compared with the use of the compound of formula (1) alone.

EXAMPLE 3

The procedure of Example 1 is repeated, using the fluorescent whitening agent of formula

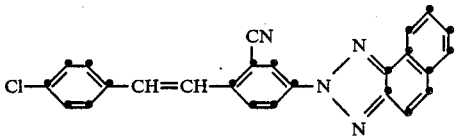

(4)

and the compound of formula (3) which has been recrystallised beforehand from dimethyl formamide, to give an increase in the degree of whiteness of 9 whiteness units as compared with the use of the compound of formula (4) alone.

EXAMPLE 4

The procedure of Example 1 is repeated, using the fluorescent whitening agent of formula

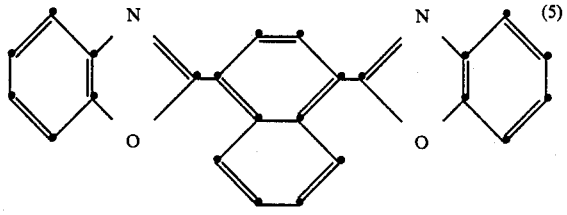

(5)

and the compound of formula (3) which has been recrystallised beforehand from dimethyl formamide, to give an increase in the degree of whiteness of 11 whiteness units as compared with the compound of formula (5) alone.

EXAMPLE 5

The procedure of Example 1 is repeated, using the fluorescent whitening agent of formula

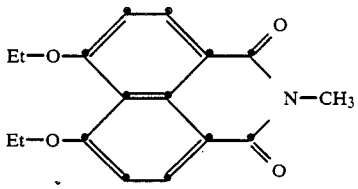

(6)

and the compound of formula (3) which has been recrystallised beforehand from dimethy formamide, to give an increase in the degree of whiteness of more than 20 whiteness units as compared with the use of the fluorescent whitening agent of formula (6) alone.

EXAMPLE 6

The procedure of Example 6 is repeated using a compound of formula

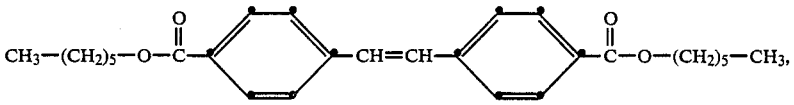

(7)

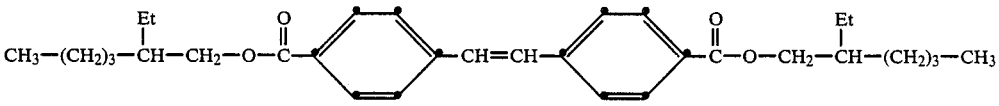

(8)

or

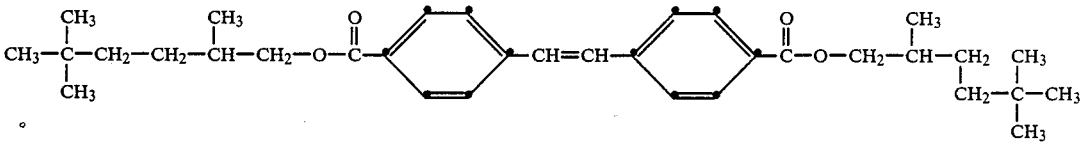

(9)

in conjunction with a fluorescent whitening agent of formula (4), (6) or (1). Increases of up to 36 whiteness units are obtained as compared with the use of the fluorescent whitening agents alone.

What is claimed is:

1. A process for increasing the degree of whiteness of polyester-containing textile material using fluorescent whitening agents, which process comprises adding to the fluorescent whitening agent, as booster, a compound which fluoresces in the absorption range of said fluorescent whitening agent wherein said booster is selected from the group consisting of:

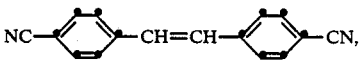

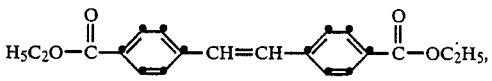

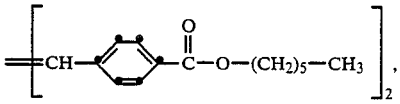

-continued

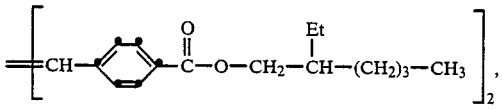

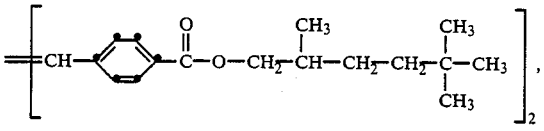

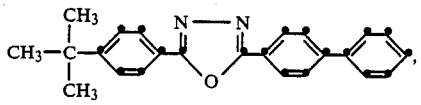

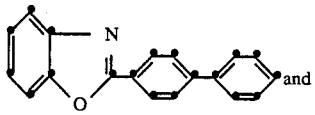

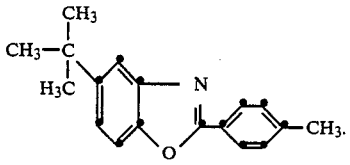

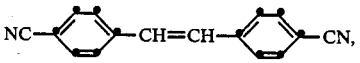

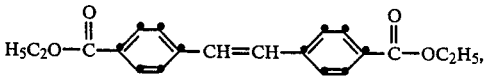

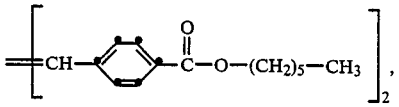

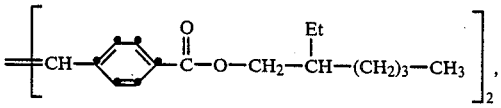

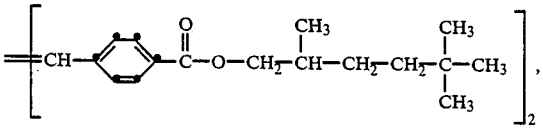

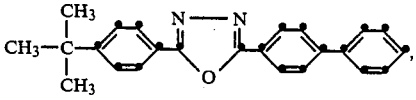

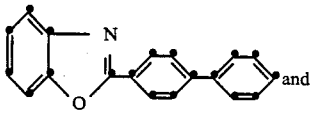

-continued

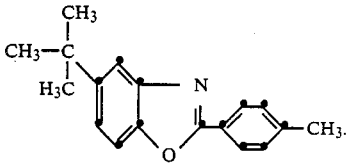

2. A process according to claim 1, wherein the booster is stilbene or a stilbene compound.

3. A process according to claim 2, wherein the booster is a stilbene compound which is substituted by cyano or $C_1$–$C_9$alkoxycarbonyl groups.

4. A process according to claim 1, wherein the booster is a heterocyclic compound which contains nitrogen or oxygen.

5. A composition for whitening polyester-containing textile material, which contains a fluorescent whitening agent and, as booster, a compound which fluoresces in the absorption range of said fluorescent whitening agent wherein said booster is selected from the group consisting of:

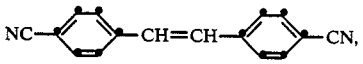

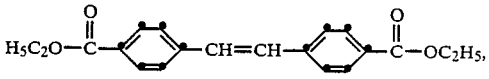

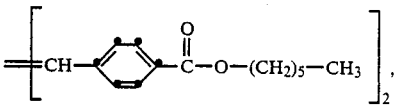

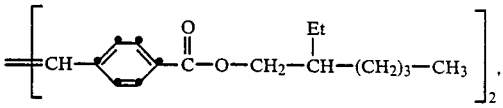

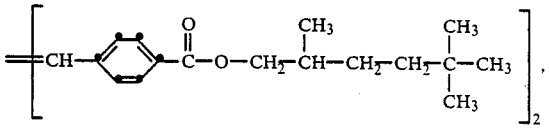

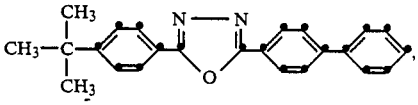

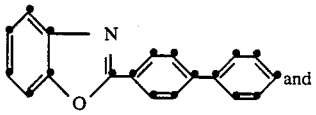

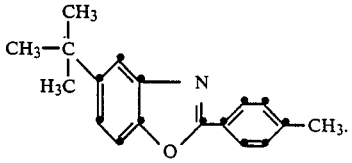

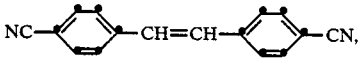

-continued
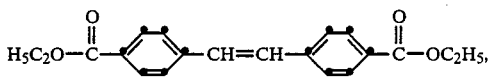
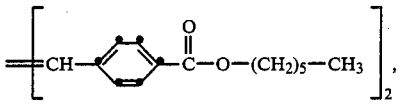
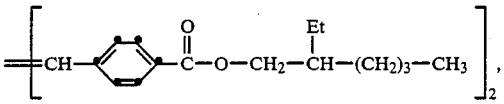
-continued
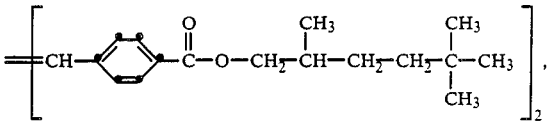
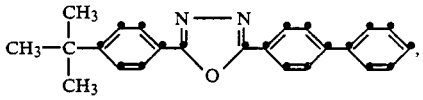
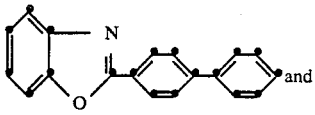
and
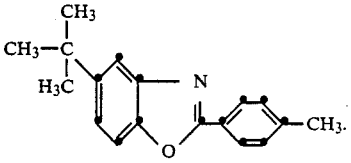
* * * * *